US005991934A

United States Patent [19]

Hsu

[11] Patent Number: 5,991,934

[45] Date of Patent: Nov. 30, 1999

[54] BAD ODOR REMOVING STOOL SEAT AND SEAT COVER

[76] Inventor: Chien-Chien Hsu, 5657 Rumble St., Burnaby B.C., Canada

[21] Appl. No.: 09/167,719

[22] Filed: Oct. 7, 1998

[51] Int. Cl.[6] ..... A47K 13/00

[52] U.S. Cl. ..... 4/217; 4/213

[58] Field of Search ..... 4/217, 213, 209 R, 4/210, 211

[56] References Cited

U.S. PATENT DOCUMENTS

| | | | |
|---|---|---|---|
| 2,849,727 | 9/1958 | Bollinger et al. | 4/217 |
| 3,501,784 | 3/1970 | Maisch | 4/217 |
| 3,599,253 | 8/1971 | Maisch | 4/217 |
| 4,780,913 | 11/1988 | Williams | 4/213 |
| 4,876,748 | 10/1989 | Chun | 4/213 |

*Primary Examiner*—David J. Walczak

*Attorney, Agent, or Firm*—Dougherty & Troxell

[57] ABSTRACT

Disclosed is a set of bad odor removing stool seat and seat cover that can be mounted on any conventional toilet bowl to function immediately. The stool seat has an internal channel that is communicable with a space in the toilet bowl via a plurality of openings spaced along an inner periphery of the stool seat. A hollow tubular portion is formed at a rear end of the stool seat to serve as a shaft for the seat cover to pivotally connected thereto. The hollow tubular portion defines an inner space communicable with the internal channel. A fan motor, filters, and a fragrant agent are sequentially mounted in the tubular portion from inner side to outer side of the tubular portion. When the fan motor is switched on, bad odorous air in the toilet bowl is drawn into the internal channel via the openings spaced on the stool seat to pass the filters and the fragrant agent, so that bad odor is removed from the air and the air is further freshened and scented before it is discharged from the tubular portion.

6 Claims, 3 Drawing Sheets

BAD ODOR REMOVING STOOL SEAT AND SEAT COVER

BACKGROUND OF THE INVENTION

The present invention relates to a set of bad odor removing stool seat and seat cover, and more particularly to a set of stool seat and seat cover that is designed to remove bad odor and send out pleasant scent when the seat cover is lifted and/or there is someone sitting on the stool seat.

Bad smell in a toilet room generally comes from urine and excrements discharged from toilet room users. A most common way to reduce or remove such bad smell in the toilet room is to enhance the ventilation of the toilet room. However, good ventilation alone is not sufficient to remove bad smell from the toilet room.

There is developed a ventilator for directly mounting inside a toilet bowl, so that bad smell from the discharged urine and/or excrements can be timely and effectively removed by the ventilator before the bad smell can escape from the toilet bowl. A disadvantage of this type of ventilator is it requires a specially designed new toilet bowl or a largely modified conventional toilet bowl to incorporate the ventilator. The installation of such specially designed or largely modified toilet bowl requires skilled worker and considerable time. Moreover, ventiducts must be built in the toilet bowl that makes the toilet bowl much more complicate and expensive than the conventional toilet bowls.

It is therefore desirable to develop other means to solve the problem of bad smell in toilet room in an economical and convenient manner.

SUMMARY OF THE INVENTION

A primary object of the present invention is to provide a set of bad odor removing stool seat and seat cover that enables timely and effectively removal of bad odor of urine and excrements before the bad odor can escape from the toilet bowl.

Another object of the present invention is to provide a set of bad odor removing stool seat and seat cover that can be conveniently mounted onto any common toilet bowl to replace the conventional stool seat and seat cover without the need of changing or modifying the toilet bowl.

To achieve the above and other objects, the present invention includes a stool seat that has an internal channel communicable with a space in the toilet bowl via a plurality of openings spaced along an inner periphery of the stool seat. A hollow tubular portion is formed at a rear end of the stool seat to serve as a shaft for the seat cover to pivotally connected thereto. The hollow tubular portion defines an inner space communicable with the internal channel. A fan motor, filters, and a fragrant agent are sequentially mounted in the tubular portion from inner side to outer side of the tubular portion. When the fan motor is switched on, bad odorous air in the toilet bowl is drawn into the internal channel via the openings spaced on the stool seat to pass the filters and the fragrant agent, so that bad odor is removed from the air and the air is further freshened and scented before it is discharged from the tubular portion.

BRIEF DESCRIPTION OF THE DRAWINGS

The above and other objects and the detailed structure of the present invention can be best understood by referring to the following detailed description of the preferred embodiments and the accompanying drawings, wherein.

DETAILED DESCRIPTION OF THE PREFERRED EMBODIMENTS

Figure 1:
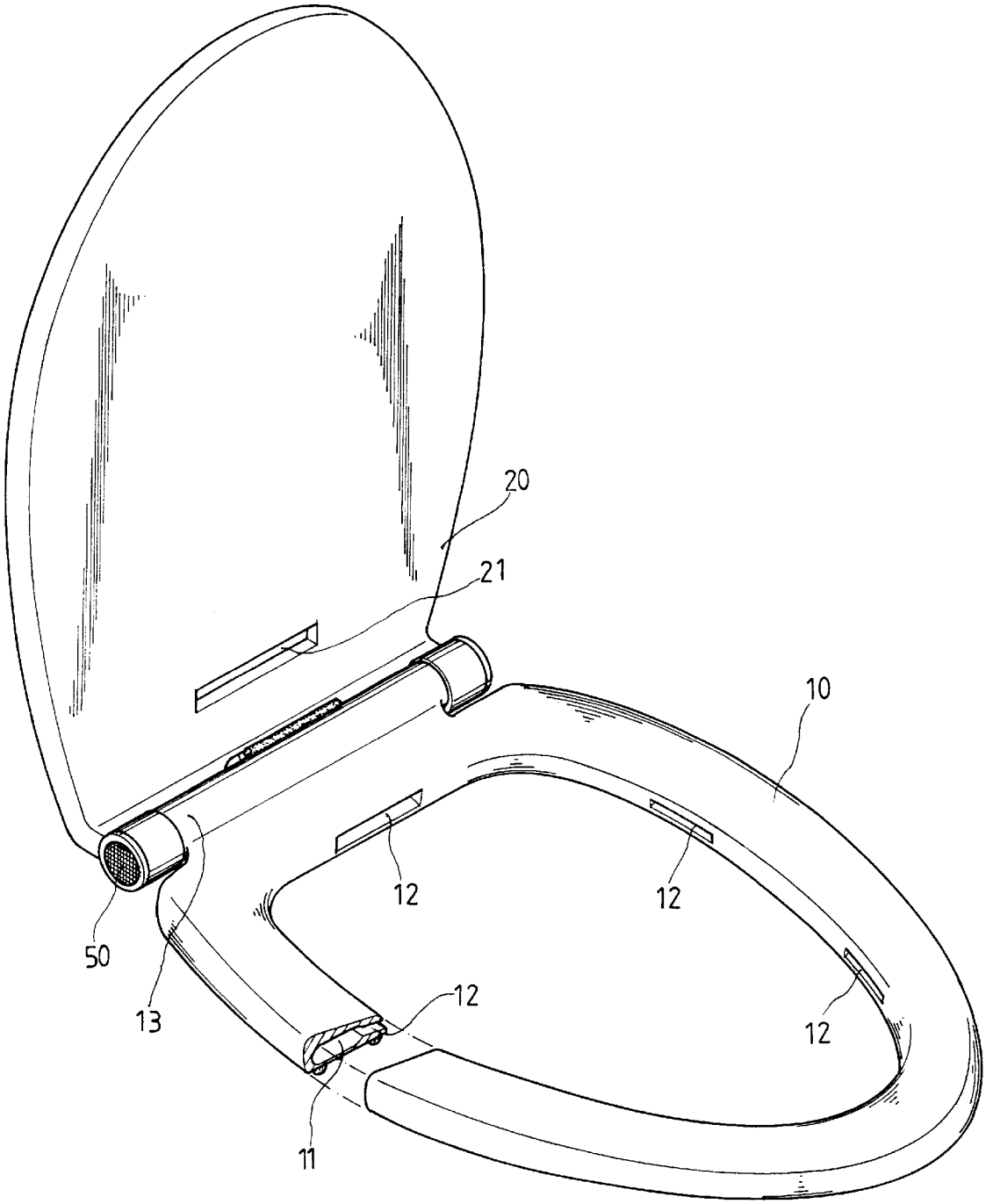
FIG. 1 is an assembled perspective of a stool seat and seat cover according to the present invention, wherein a part of the stool seat is cut away to show an internal channel thereof.
Figure 2:
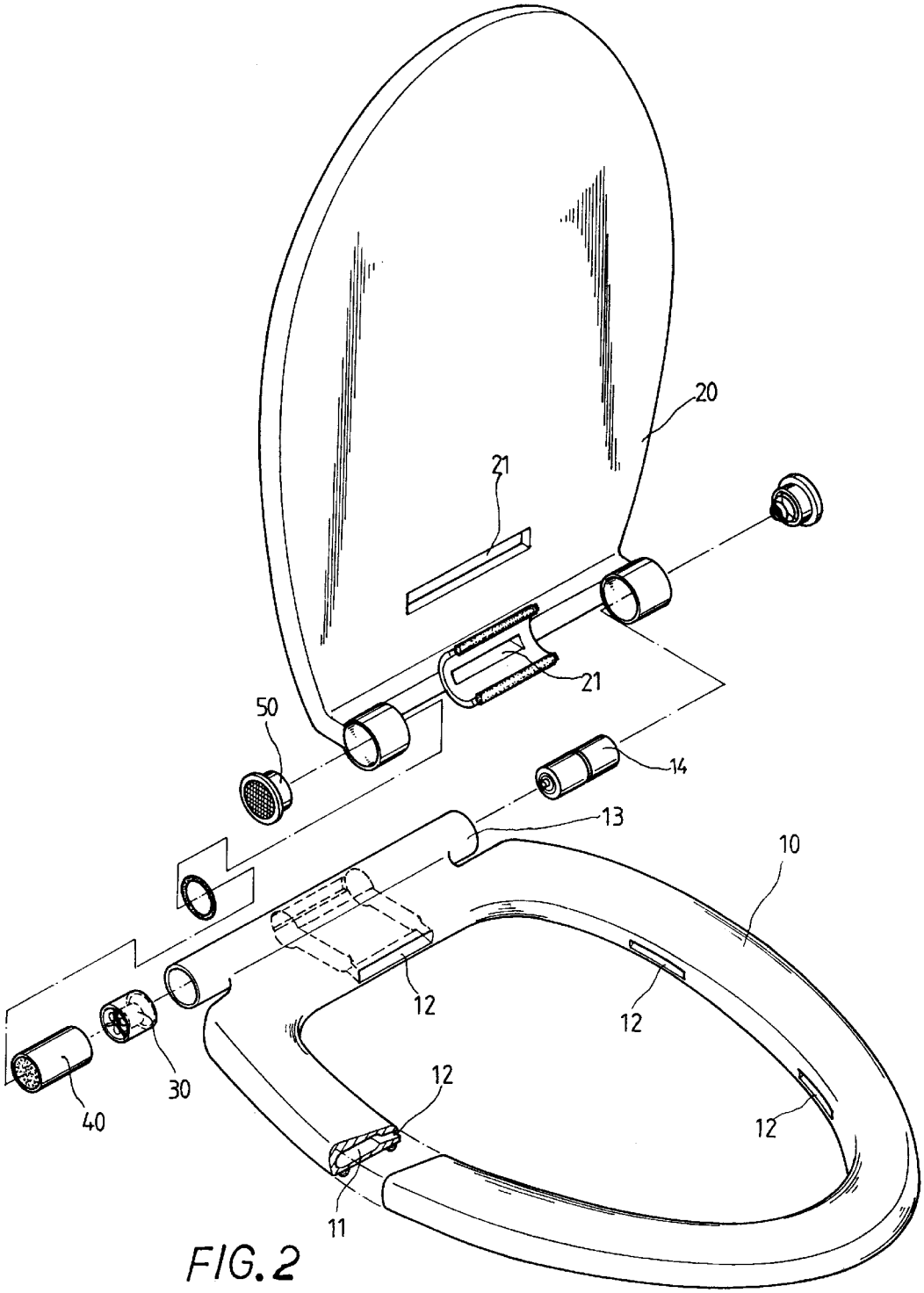
FIG. 2 is an exploded perspective of the stool seat and seat cover of FIG. 1.
Figure 3:
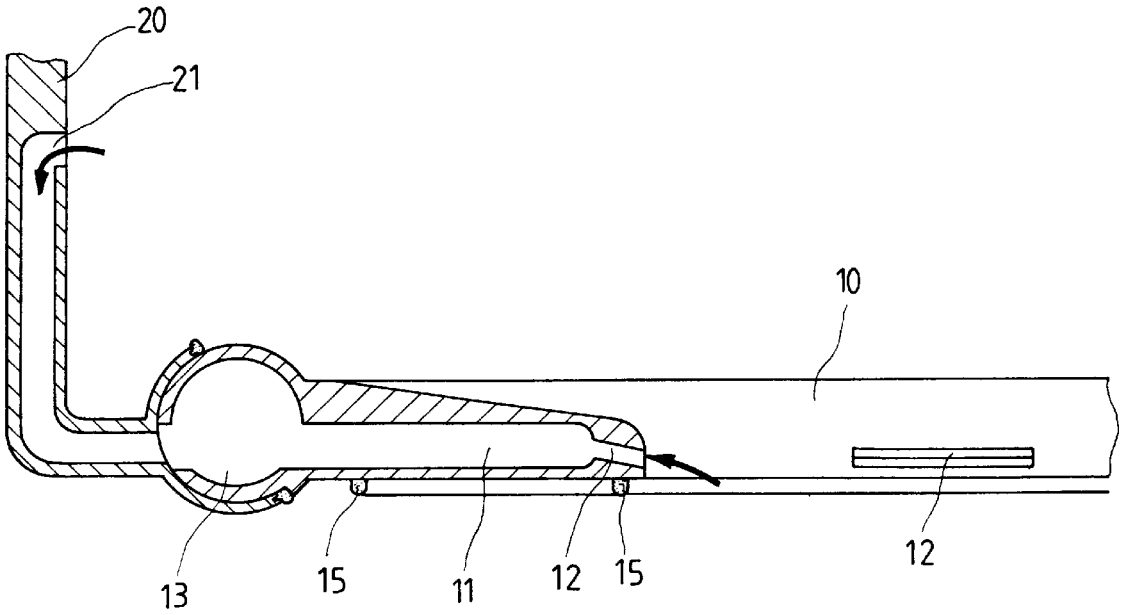
FIG. 3 is a fragmentary side sectional view of the stool seat and seat cover of FIG. 1 with the seat cover in a lifted position.
Figure 4:
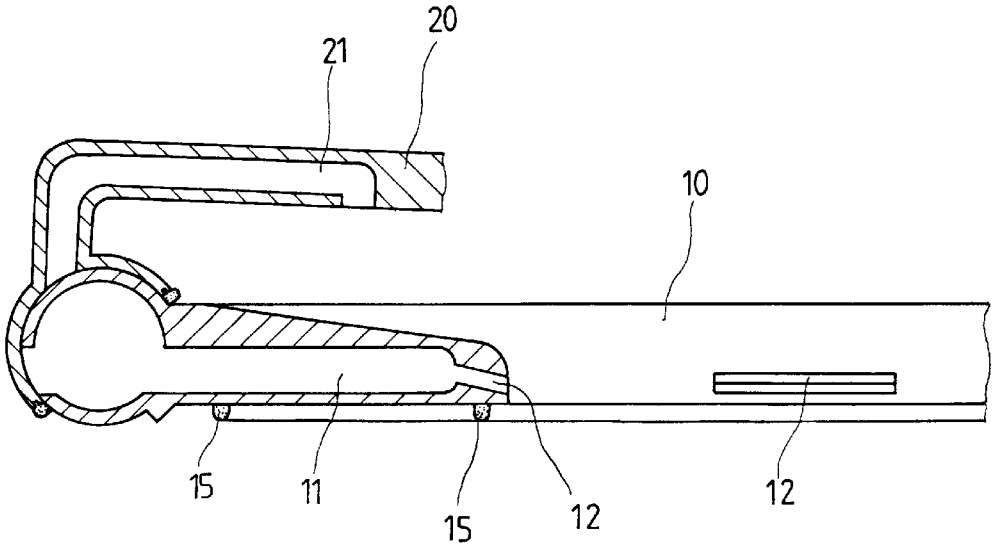
FIG. 4 is a fragmentary side sectional view similar to FIG. 3 but with the seat cover in a closed position.

Please refer to FIGS. 1 and 2 at the same time. The present invention includes a stool seat 10, a seat cover 20 pivotally connected to the stool seat 10, a fan motor 30, filters 40, and an amount of fragrant agent 50.

The stool seat 10 has an internal channel 11 defining a substantially annular inner space extending along a whole length of the stool seat 10. A plurality of openings 12 are spaced along an inner periphery of the stool seat 10 to communicate the inner space of the internal channel 11 with a space generally surrounded by a toilet bowl (not shown) onto which the stool seat 10 is mounted. A rear end of the stool seat 10 is formed into a hollow tubular portion 13. An inner space defined by the hollow tubular portion 13 is communicable with the internal channel 11. The tubular portion 13 also serves as a shaft for the seat cover 20 to pivotally connect thereto. Batteries 14 are mounted in the tubular portion 13 near a first end thereof. The first end of the tubular portion 13 is then closed. The fan motor 30, the filters 40, and the fragrant agent 50 are sequentially mounted into the tubular portion 13 from a second end thereof opposite to the first end. Thereby, when the fan motor 30 is started, air with bad odor in the toilet bowl (not shown) is drawn into the internal channel 11 via the openings 12 to pass the filters 40 and the fragrant agent 50. The bad odor is removed when the drawn air passes the filters 40. The resultant odorless air keeps moving through the fragrant agent 50 and is discharged from the second end of the tubular portion 13 to send out freshened air with pleasant smell.

After old stool seat and seat cover are dismounted from the toilet bowl, the stool seat and seat cover of the present invention can be easily mounted on the toilet bowl to function immediately. There is no need to change or modify the toilet bowl at all. By timely turning on the fan motor 30, bad odor of discharged urine or excrements diffused in the air in the toilet bowl can be immediately drawn into the internal channel 11 of the stool seat 10 via the openings 12 before the odor can escape from the toilet bowl. The fan motor 30 keeps operating to draw the bad odorous air into the tubular portion 13 to pass through the filters 40 and the fragrant agent 50, so that bad odor is removed and freshened air is discharged from the tubular portion 13 of the stool seat 10.

Please now refer to FIGS. 1 to 4 at the same time. The seat cover 20 is optionally provided at suitable position with an inner space, an upper end of which is an opening 21 on the seat cover facing and communicable with an open space above the toilet bowl (not shown), and at a lower end thereof is another opening communicable with the hollow tubular portion 13 of the stool seat 10. Whereby, bad odorous air diffusing around the seat cover 20 can also be drawn into the tubular portion 13 via the openings 21 and then be filtered and freshened when the air passes the filters 40 and the fragrant agent 50.

A ring type pad 15 matching the shape of the stool seat 10 may be attached to a bottom surface of the stool seat 10, so that the seat 10 tightly contacts with a top edge of the toilet bowl to prevent outside clean and odorless air from coming into the toilet bowl and thereby enables high efficient drawing and filtering of bad odorous air.

The fan motor 30 can be controlled in different ways. For example, an electric eye maybe properly installed such that the fan motor 30 is automatically started when a user gets close enough to the toilet bowl. Alternatively, a contact switch may be installed at the bottom surface of the seat 10, such that the fan motor 30 is actuated by a downward load applied to the seat 10 by a user sitting thereon. Or, a switch may be installed at a position where the seat cover 20 is pivotally connected to the seat 10, such that the fan motor 30 is started when the seat cover 20 is lifted.

Moreover, the fan motor 30, the filters 40, and the fragrant agent 50 may be otherwise together or separately packed in one or more containers and be mounted at suitable position or positions. In this case, the containers must have air inlets and outlets communicable with the tubular portion 13 to similarly achieve the objects of the present invention.

In brief, the present invention may be actuated to work in many different manners. And, the type and arrangement of the starting switch, as well as the positions of the fan motor, the filters and the fragrant agent all can be changed without departing from the spirit of the invention or the scope of the subjoined claims.

With the stool seat and seat cover of the present invention, bad odorous air from discharged urine and excrements can be effectively freshened before the bad odor can escape from the toilet bowl. Moreover, the present invention can be easily installed to replace the conventional stool seat and seat cover without the need to change or modify the toilet bowl. Therefore, the present invention is economical and practical for use.

What is claimed is:

1. A bad odor removing stool seat and seat cover, comprising a stool seat, a seat cover pivotally connected to said stool seat, a fan motor, and at least one filter; said stool seat having an internal channel extending along a full length of said stool seat, a plurality of openings being spaced along an inner periphery of said stool seat in communication with said internal channel and with a space surrounded by a toilet bowl onto which said stool seat is adapted to be mounted, a hollow tubular portion extending from a rear end of said stool seat to define a space in communication with said internal channel and to serve as a shaft to pivotally connect said seat cover to said stool seat; said fan motor and said filter being mounted in a closed space in communication with said hollow tubular portion; said seat cover is provided with an inner space in communication with said hollow tubular portion of said stool seat via a lower opening and with an open space above said stool seat via an upper opening on an inner surface of said seat cover; whereby when said fan motor is started, bad odorous air in said toilet bowl is drawn into said internal channel via said openings spaced on said stool seat and sent to pass through said filter, so that bad odor is removed from the air before the air is discharged from said tubular portion of said stool seat.

2. The bad odor removing stool seat and seat cover as claimed in claim 1, further comprising a fragrant agent mounted in said closed space in communication with said tubular portion and located downstream from said filter, whereby air passed through and filtered by said filter is further sent to pass said fragrant agent to be freshened and scented before being discharged from said tubular portion.

3. The bad odor removing stool seat and seat cover as claimed in claim 1, wherein said fan motor, and said filter are sequentially mounted in said hollow tubular portion from an inner side to an outer side thereof.

4. The bad odor removing stool seat and seat cover as claimed in claim 1, wherein said fan motor, and said filter are located outside said stool seat and said seat cover but are sequentially communicably connected to said hollow tubular portion from an inner side to an outer side thereof.

5. The bad odor removing stool seat and seat cover as claimed in claim 2, wherein said fan motor, said filter and said fragrant agent are sequentially mounted in said hollow tubular portion from an inner side to an outer side thereof.

6. The bad odor removing stool seat and seat cover as claimed in claim 2, wherein said fan motor, said filter and said fragrant agent are located outside said stool seat and said seat cover but are sequentially communicably connected to said hollow tubular portion from an inner side to an outer side thereof.

* * * * *